US005445564A

United States Patent [19]

Kastner

[11] Patent Number: 5,445,564

[45] Date of Patent: Aug. 29, 1995

[54] FUNFAIR RIDE

[76] Inventor: Helmut Kastner, Goldene Aue 23, D-28329 Bremen, Germany

[21] Appl. No.: 128,700

[22] Filed: Sep. 30, 1993

[30] Foreign Application Priority Data

Oct. 1, 1992 [DE] Germany ..... 42 32 932.9

[51] Int. Cl.[6] ..... A63G 31/00

[52] U.S. Cl. ..... 472/31; 472/16

[58] Field of Search ..... 472/31, 32, 33, 36, 472/16, 26, 25, 43, 44, 45, 49

[56] References Cited

U.S. PATENT DOCUMENTS

| | | | |
|---|---|---|---|
| 2,562,324 | 7/1951 | McBride . | |
| 2,643,122 | 6/1953 | Beckett | 472/16 |
| 3,196,557 | 7/1965 | Davidsen et al. | 472/31 X |
| 3,294,398 | 12/1966 | Buechler | 472/31 X |

FOREIGN PATENT DOCUMENTS

| | | |
|---|---|---|
| 660311 | 4/1938 | Germany . |
| 660999 | 5/1938 | Germany . |

*Primary Examiner*—Carl D. Friedman
*Assistant Examiner*—Creighton Smith
*Attorney, Agent, or Firm*—Sughrue, Mion, Zinn, Macpeak & Seas

[57] ABSTRACT

Funfair rides (10) on which the passenger reception (17) is assigned to the end of a cantilever arm (14) which can move about a horizontal axis of rotation (13) are known. The movement of the passenger reception corresponds substantially to that of the circular path of the cantilever, so that only very limited impressions of movement can be conveyed.

According to the invention, it is provided that the passenger reception (17) is able to move on at least one further circular path in the region of the end of the cantilever arm (14). In this case, the passengers are moved on a cycloidal path.

8 Claims, 7 Drawing Sheets

FUNFAIR RIDE

BACKGROUND OF THE INVENTION

The invention relates to a funfair ride.

Such funfair rides are already broadly known. On them, the passenger reception (receptacle) is assigned to the end of the cantilever arm, which can be rotatingly driven in an approximately vertical plane, in such a way that the said reception can be moved in a manner substantially corresponding to the circular path of the cantilever. As a result, only a very limited impression of movement can be conveyed to the passengers.

SUMMARY OF THE INVENTION

The invention is based on the object of providing a funfair ride which allows varied motional states of the passenger reception (receptacle) and makes it possible for the passengers to experience novel thrills.

According to the invention, the object is achieved by the passenger reception being able to move on at least one further circular path in the region of the end of the cantilever arm. As a result, the passengers are presented with increased pleasure during the ride.

The passenger can advantageously be moved on an approximately cycloidal path if the passenger reception can be moved on a circular path about an additional axis of rotation which runs parallel to the axis of rotation of the circular path of the cantilever.

In a specific embodiment, an annular track is arranged at at least one end of the cantilever arm. The annular track in this case forms a runway for the passenger reception. The passenger reception can travel in a revolving manner along on this annular track and, as a result, the passengers can be offered an additional looping effect (for looping on the circular path of the cantilever).

If a drive unit is to be used for the already-mentioned movement and also for a further additional movement of the passenger reception, it is expedient to connect the annular track fixedly to the end of the cantilever arm. The passenger reception can then easily be made to travel along the circular path by means of the drive.

However, from time to time it is also advantageous to assign the drive for the first-mentioned additional movement of the passenger reception to the cantilever arm. In this case, the annular track is expediently articulated in a relatively movable manner on the cantilever arm. In this case, the passenger reception is connected to the annular track such that it is moved along on the circular path with the consequently rotatably driven annular track.

According to a further embodiment, the variety of movement of the passenger reception is further extended if the passenger reception can also further be moved about its own axis. This axis is arranged such that it intersects the axis of rotation about which the passenger reception moves on the annular track. The passenger reception can consequently be moved on two different circular paths in addition to the circular path of the cantilever and consequently in virtually any desired plane, it being possible for the movement on the respective circular path to take place in both directions and also mutually independently. As a result, varied motional states can be produced, the control of which is expediently performed on the basis of empirical findings with the aim of optimizing the pleasurable effects for the passenger.

Further features of the invention and its advantages emerge from the remaining patent claims and the following description.

Several exemplary embodiments of the invention are explained in more detail below with reference to the drawing, in which:

DESCRIPTION OF PREFERRED EMBODIMENTS

Figure 1:
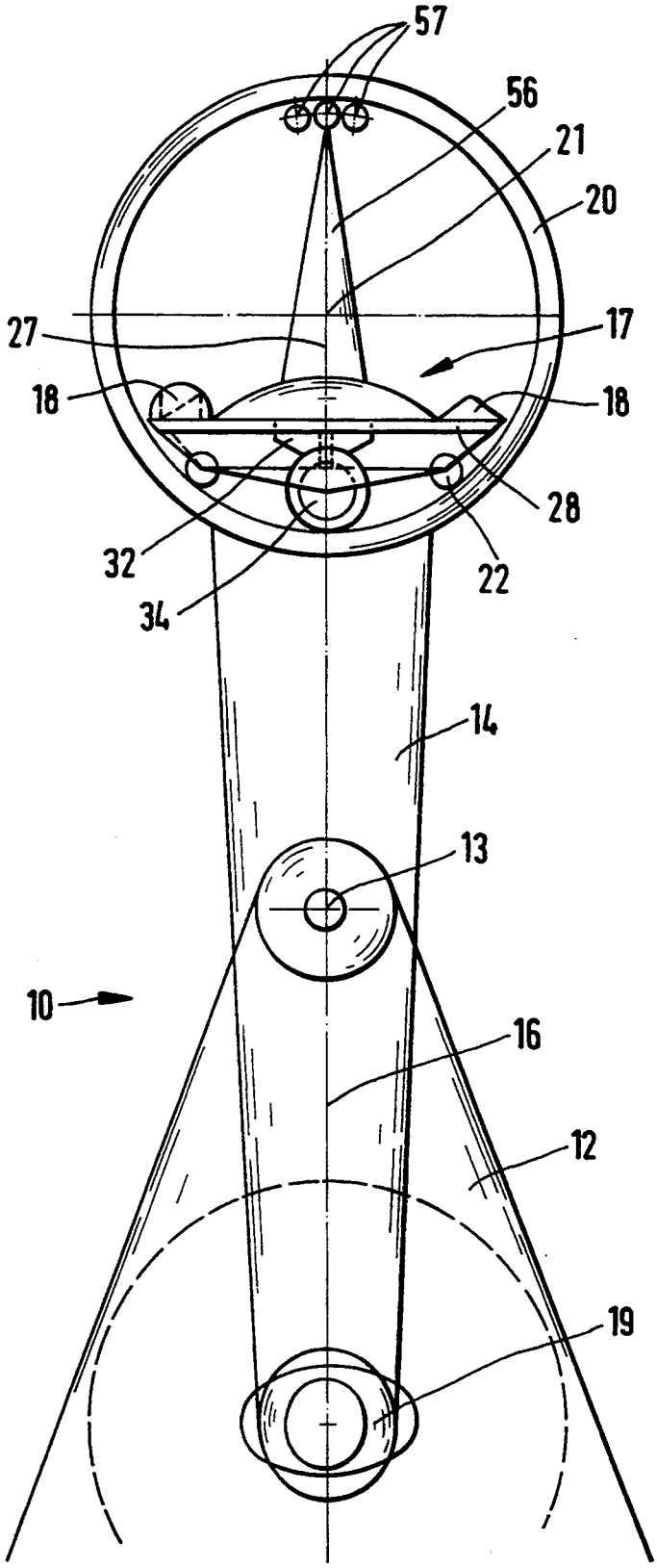
FIG. 1 shows a side view of a funfair ride in a diagrammatic and partial representation.

A funfair ride 10 (FIG. 1) has a frame 11 (FIG. 7), which bears between two bearing blocks 12 a cantilever arm 14 which is rotatably or pivotably movable about a horizontal axis of rotation 13 and has at least one passenger reception (receptacle) 17. The rotational movement of the cantilever arm 14 in a vertical plane takes place by means of a drive (not shown), which is assigned to the frame 11. The frame 11 may be designed both for stationary operation and also mobile operation of the funfair ride 10.

It is possible to assign to the frame 11 a slewing ring 15, so that the frame 11, with the cantilever arm 14, and the passenger reception 17 are rotatable about a vertical axis 16.

The axis of rotation 13 runs approximately centrally through the cantilever arm 14. A free end of the cantilever arm 14 is assigned the passenger reception 17 with a plurality of seats 18. The other end, on the other hand, bears in the exemplary embodiment according to FIG. 1 a counterweight 19, it also being possible to arrange instead of this a (second) passenger reception 17 at this end.

The passenger reception 17 can be made to travel along an annular track 20, to be precise along the inside of the annular track 20. As a result, the passenger reception 17 receives a first additional movement in addition to that of the cantilever arm 14. This additional movement takes place on a circular path about a further central axis 21. This rotational movement takes place at the end region of the cantilever arm 14 within the annular track 20. In this arrangement, the central axis 21 runs parallel to the axis of rotation 13 of the cantilever arm 14, in which case the passenger reception 17 with the passengers travels over an approximately cycloidal path on account of the superimposing of the movements of the cantilever arm 14 with the first additional movement.

The annular track 20 is connected fixedly to the end of the cantilever arm 14. The passenger reception 17 is held by means of carrying or supporting rollers 22 in such a way that it can travel within the annular path 20 and along it. The passenger reception 17 is assigned a drive unit 23, which has a drive wheel 24, which bears against and rolls on the inner lateral surface of the annular track 20.

The rollers 22 are evenly distributed, approximately in the shape of a triangle, on the circumference of the annular track 20. They may bear against both the outer lateral surface and inner lateral surface of the annular track 20 or be held in a form-fitting manner, positively guided to a certain extent, in a guide groove (not shown) of the annular track 20. As a result, the rollers 22 form supporting points of the passenger reception 17 on the annular track 20.

Figure 3:
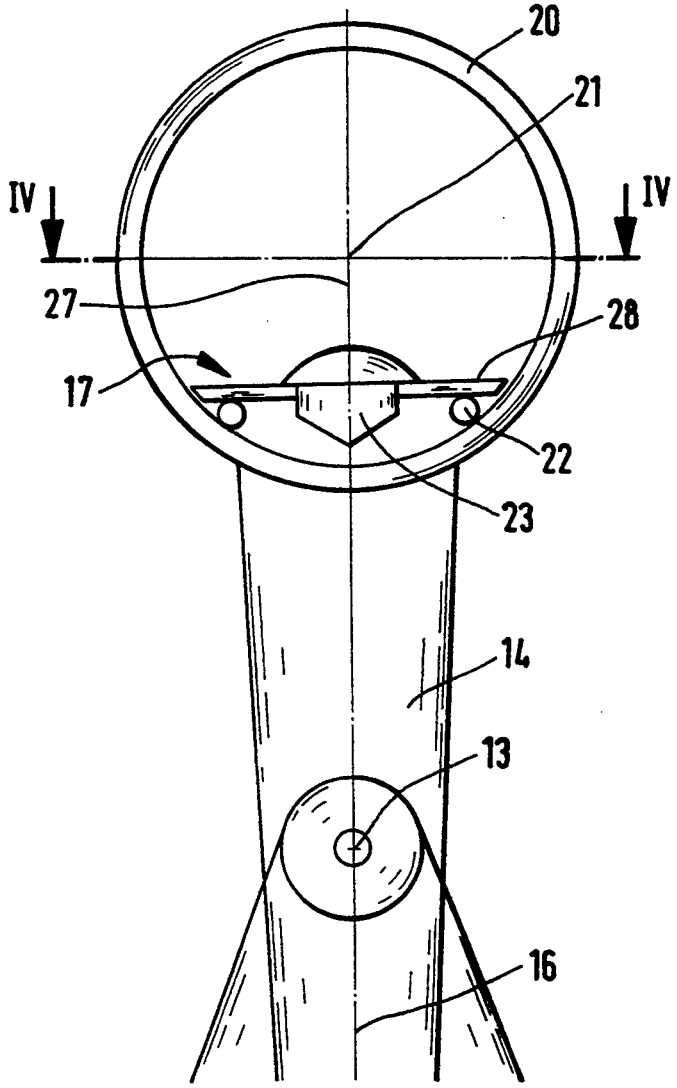
FIG. 3 shows an alternative design of a passenger reception in a view analogous to FIG. 1.
Figure 4:
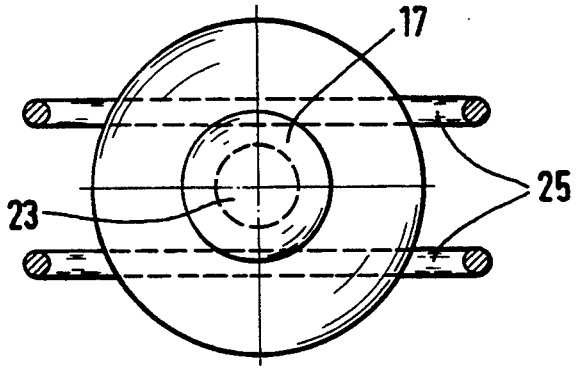
FIG. 4 shows a section IV—IV according to FIG. 3.

The annular track 20 is formed by two parallel rings 25 (FIGS. 3 and 4), between which the passenger reception 17 is held approximately symmetrically. In this arrangement, the rings 25 form rails for the rollers 22 of the passenger reception 17, which span an (imaginary) cylinder lateral surface, the longitudinal central axis of which corresponds to the central axis 21 of the annular track 20. The passenger reception 17 travels along on the inside of the annular track 20 or of the imaginary cylinder lateral surface.

Figure 2:
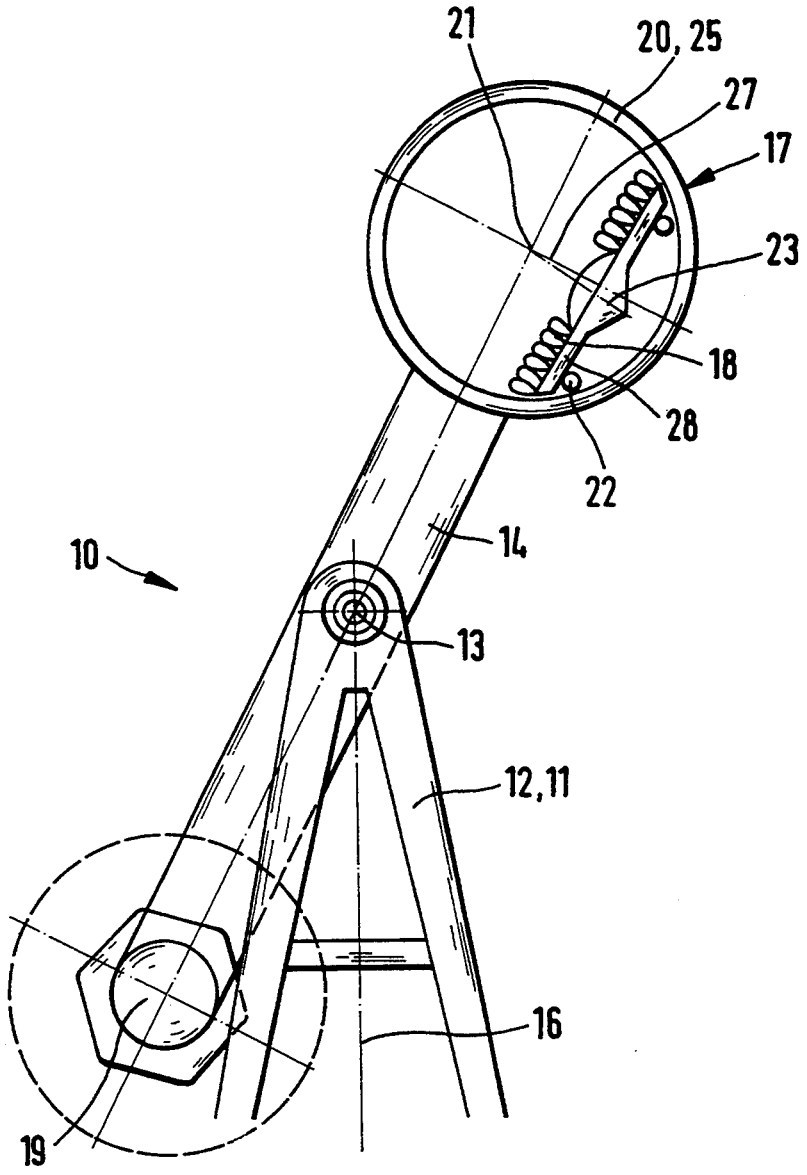
FIG. 2 shows a view according to FIG. 1 in another relative arrangement.

In the case of the position of the funfair ride 10 represented in FIG. 2, on the one hand the cantilever arm 14 has pivoted out of its previously vertical position and on the other hand the passenger reception 17 has also traveled within the annular track 20. It can be seen in FIG. 2 that the passenger receptions 17 with the passengers are moved on two different circular paths of different diameter.

A further or second additional movement of the passenger reception 17 is provided by the fact that the passenger reception 17 is also rotatably movable about an axis of rotation 27, virtually the axis of symmetry of the passenger reception 17 itself, for which purpose the drive unit 23 can also be used. In this case, this rotational movement is preferably not performed by the entire passenger reception 17, but by a baseplate 28 carrying the seats 18. The passengers are consequently always able to be brought into the movement of the cantilever arm 14 and also the two additional movements of the passenger reception 17.

The axis of rotation 27 is in this case arranged such that it intersects, to be precise preferably at right angles, the central axis 21, about which the passenger reception 17 moves during its movement on the circular path along the annular track 20. In this case, due to the movement of the cantilever arm 14 and the two additional movements, the most varied of motional states can be accomplished.

Figure 5:
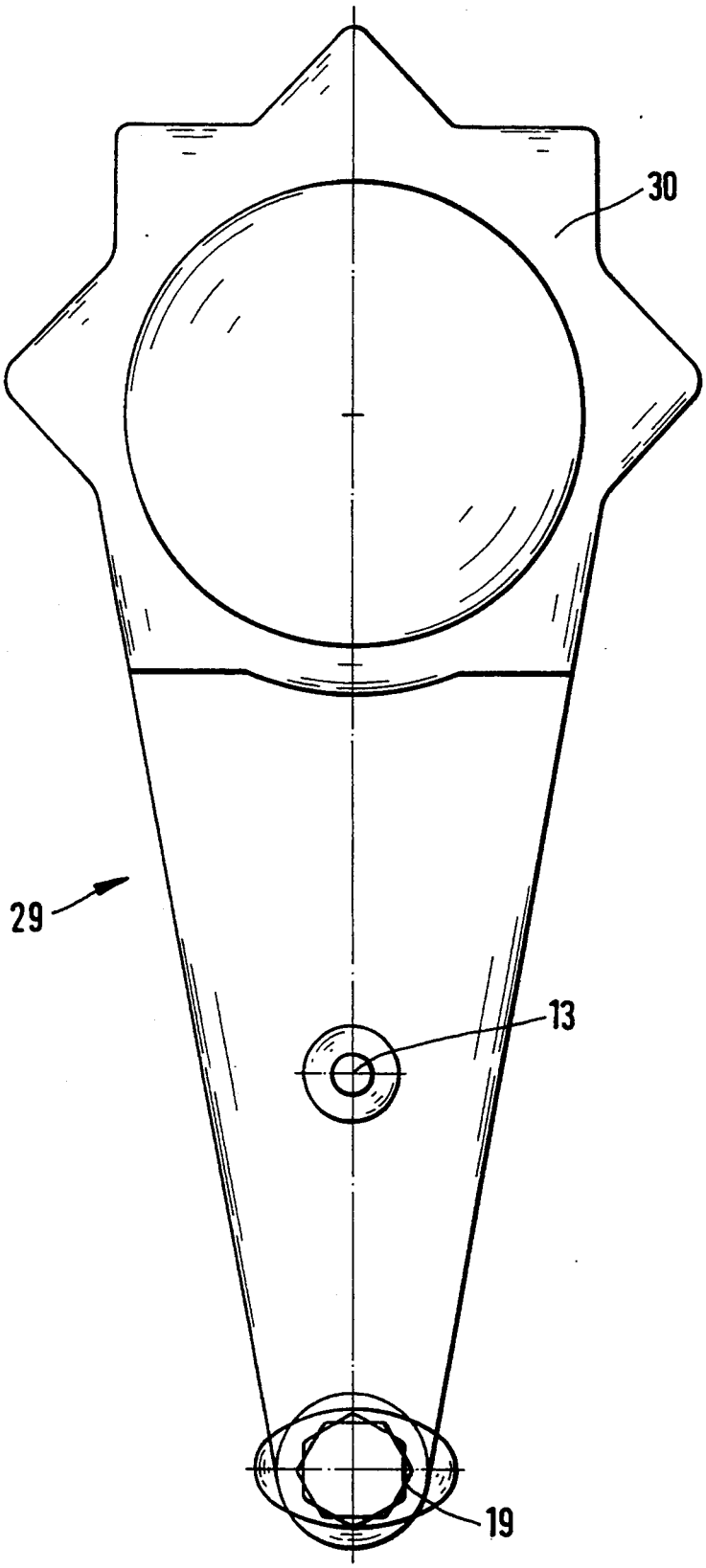
FIG. 5 shows a side view of a cantilever arm.

Represented in FIG. 5 is a cantilever arm 29 which on the one hand is held off-centrally from the axis of rotation 13 and on the other hand is provided with a particularly decorative, stellar-designed annular track 30. In spite of the off-center arrangement of the axis of rotation 13, a balance of the two arms of the cantilever arm 29 is provided due to a corresponding counterweight 19.

Figure 6:
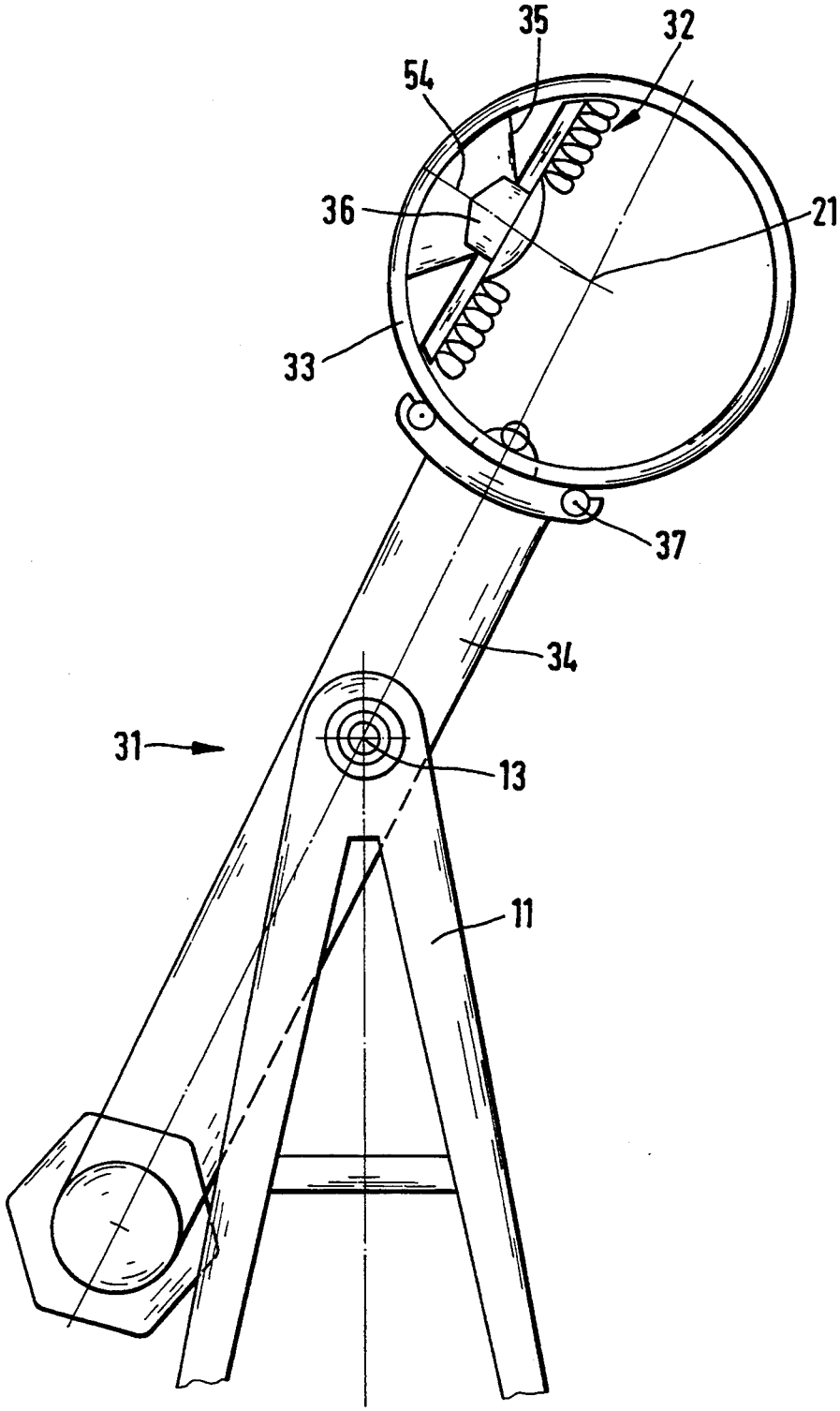
FIG. 6 shows a side view of a further exemplary embodiment of the funfair ride.

FIG. 6 shows an alternatively designed funfair ride 31. It differs from the funfair ride 10 described above only by a different arrangement of the annular track 33 on the cantilever arm 34. The annular track 33 is arranged relatively movably on the free end of a cantilever arm 34. The passenger reception 32 is, on the other hand, fixedly connected to the annular track 33, so that it can be moved by the annular track 33 along with it. The passenger reception 32 is held by means of supports 35 on the annular track 33.

For the rotation of the annular track 33 or passenger reception 32 corresponding to the first additional movement, the free end of the cantilever arm 34 is assigned three rollers 37, of which two bear against or roll on the outer lateral surface and a central one bears against or rolls on the inner lateral surface of the annular track 33, at least one of these rollers 37 being driven by a drive unit (not shown), assigned to the cantilever arm 34. The second additional movement of the passenger reception 32 relative to the annular track 33 about an axis of rotation 54 takes place by means of a drive unit 36, assigned to the passenger reception 32.

Figure 7:
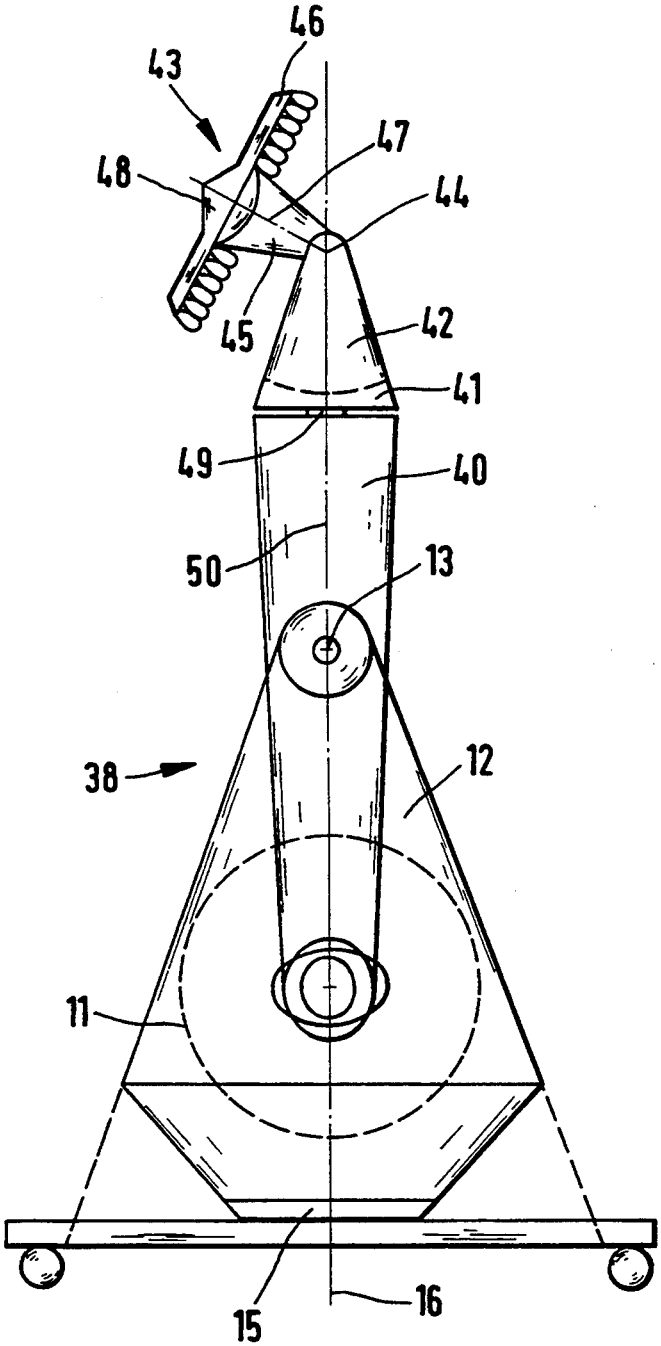
FIG. 7 shows a side view of a further exemplary embodiment of the funfair ride.

A further funfair ride 38 according to FIG. 7 does not differ with regard to the two additional movements of the passenger reception 39 from the funfair rides 10 and 31 described above. In this case, the end of the cantilever arm 40 is of a fork-shaped design or is provided with a fork 41. Between fork arms 42, the passenger reception 43 is rotatable about the axis of rotation 44, which joins the end regions of the fork arms 42, in a manner corresponding to the first additional movement.

The passenger reception 43 is additionally held in the manner of a swing by means of a suspension 45 at the axis of rotation 44. Here the first additional movement of the passenger reception 43 takes place about the axis of rotation 44.

The second additional movement takes place by the passenger reception 43, or a baseplate 46 of the same, being rotated about an axis of rotation 47 by means of a drive unit 48.

In the case of the funfair ride 38, a third additional movement comes about by the passenger reception 43 being rotatable with the fork 41 about the end of the cantilever arm 40. For this purpose, the fork 41 is mounted rotatably by means of a turning pin 49 in the end of the cantilever arm 40. This rotational movement takes place about the longitudinal axis 50 of the cantilever arm 40.

In addition, the fork 41 is also displaceable along the longitudinal axis 50 in the turning pin mounting, so that the diameter of the path which the passenger reception 43 describes on the circular path of the cantilever is variable.

Figure 8:
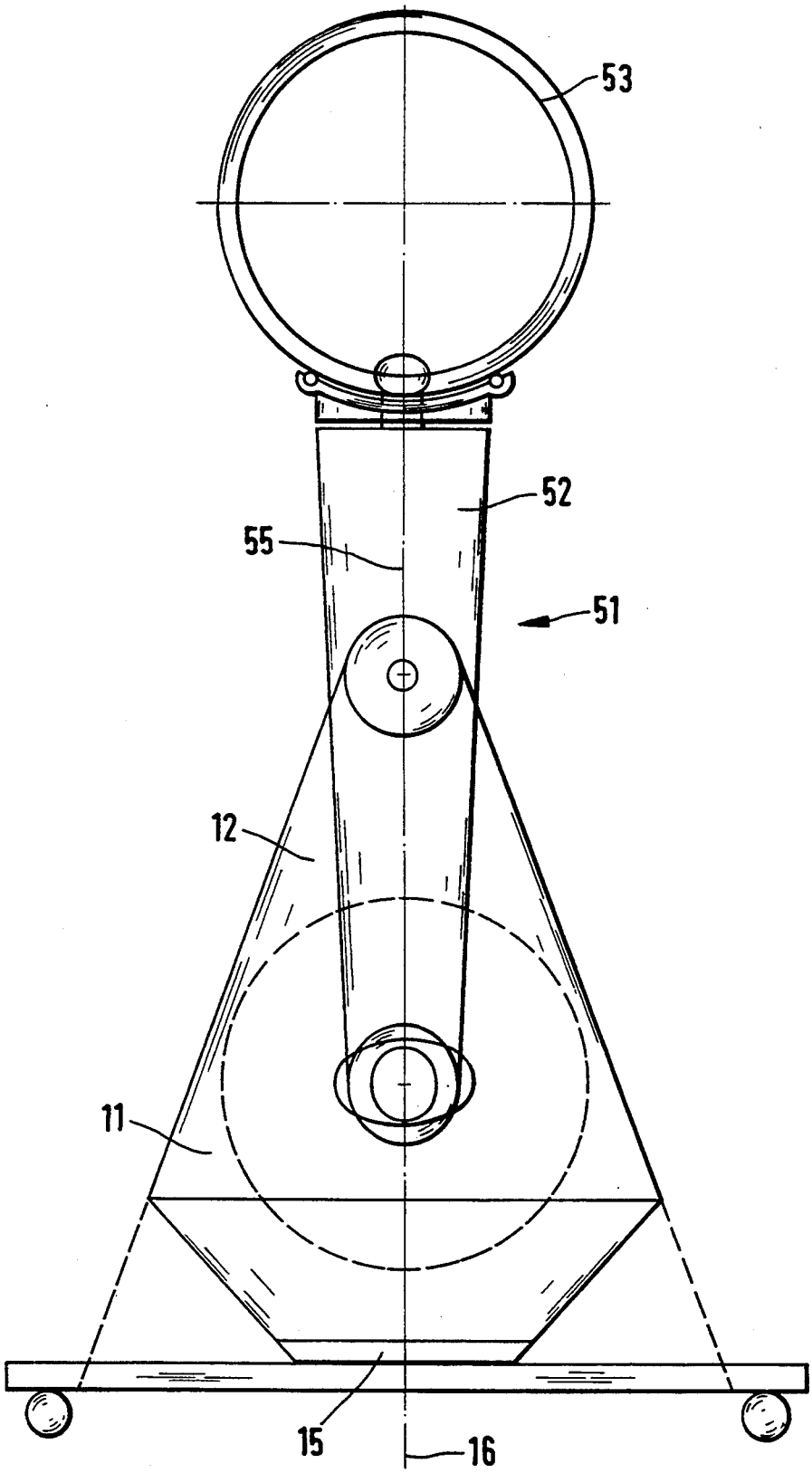
FIG. 8 shows a side view of a further exemplary embodiment of the funfair ride.

The funfair ride 51 (FIG. 8) coincides with the funfair ride 31 with regard to the first two additional movements. In addition, however, here too a third additional movement is provided, by the end of the cantilever arm 52 holding the annular track 53 in a rotationally movable manner, to be precise approximately analogously to the fork 41 of the funfair ride 38 described above. In addition, the annular track 53, with the passenger reception (not shown here), may also be displaceable on the longitudinal axis 55 of the cantilever arm 52 for varying the diameter of the circular path of the cantilever.

The individual movements of the passenger receptions, in particular the additional movements, may possibly be controlled individually by the passengers in the respective passenger reception, whereby the thrill during the ride is further increased.

What is claimed is:

1. A funfair ride comprising a longitudinally extending cantilever arm, which is rotatable about a horizontal axis of rotation, and at least one passenger receptacle which is arranged at a free end of the cantilever arm and is movable by the cantilever arm on a first circular path of the cantilever arm, said funfair ride further comprising means for separately driving said cantilever arm (14) and said passenger receptacle (17,32) in such a way that said passenger receptacle, in a region of said free end of said cantilever arm, is driven on at least one additional circular path having a central axis (21), which extends parallel to said horizontal axis (13) of rotation of the cantilever arm, so as to move said passenger receptacle (17,32) on an approximately cycloidal path.

2. The funfair ride as claimed in claim 1, further comprising an annular track (20, 33) forming a cylindrical surface on an inside of which said passenger receptacle is peripherally driven.

3. The funfair ride as claimed in claim 2, wherein said annular track (20) is fixedly connected to the cantilever arm (14), and the passenger receptacle (17) travels along said annular track.

4. The funfair ride as claimed in claim 2, wherein said annular track (33,53) is mounted relatively movably at said free end of said cantilever arm (34,52), and said passenger receptacle (32) is connected to said annular track (33) in such a way that said receptacle moves along with the annular track (33).

5. The funfair ride as claimed in claim 2, wherein said passenger receptacle (17,32) is additionally movable about another axis (27) of rotation which intersects, at approximately a right angle, said central axis (21) of movement of said passenger receptacle (17,32) along said annular track (20,33).

6. The funfair ride as claimed in claim 1, wherein said end of the cantilever arm (40) has the shape of a fork having fork arms (42) with end regions, and wherein said passenger receptacle (43) is arranged between said fork arms (42) like a swing, and moves on a circular path about an axis (44) of rotation at the end regions of the fork arms (42).

7. The funfair ride as claimed in claim 5, wherein said free end of said cantilever arm (40) has a fork (41) which is movable about an axis of rotation which corresponds to the longitudinal axis (50) of said cantilever arm (40).

8. The funfair ride as claimed in claim 7, wherein said fork (41) is displaceable along the longitudinal axis (50) of the cantilever arm (40) in such a way that the circular path of the cantilever arm has a diameter that is variable in relation to the passenger receptacle (43).

* * * * *